United States Patent [19]

Cuthbertson

[11] 4,390,051

[45] Jun. 28, 1983

[54] SECURING A LINER WITHIN A FLEXIBLE CONTAINER

[75] Inventor: Bruce Cuthbertson, Macon, Ga.

[73] Assignee: Bonar Industries Inc., Macon, Ga.

[21] Appl. No.: 250,605

[22] Filed: Apr. 3, 1981

[51] Int. Cl.[3] ..... B65D 90/04; B65D 90/08; B65D 90/20

[52] U.S. Cl. ..... 150/1; 150/12; 229/55

[58] Field of Search ..... 150/0.5, 1, 3, 12; 220/400, 403, 404; 229/53, 55

[56] References Cited

U.S. PATENT DOCUMENTS

| | | | |
|---|---|---|---|
| 2,378,159 | 6/1945 | Royer | 150/0.5 |
| 2,696,235 | 12/1954 | Toffolon | 150/0.5 |
| 2,969,036 | 1/1961 | Brown | 150/0.5 X |
| 3,036,752 | 5/1962 | Elliott | 220/404 |
| 3,087,491 | 4/1963 | Gewecke et al. | 150/0.5 X |
| 3,128,904 | 4/1964 | Reilly | 220/404 |
| 3,870,358 | 3/1975 | Bennett | 150/1 X |
| 3,949,901 | 4/1976 | Tokita | 150/0.5 X |
| 3,961,655 | 6/1976 | Nattrass et al. | 150/1 |
| 4,113,146 | 9/1978 | Williamson | 150/1 X |
| 4,300,608 | 11/1981 | Cuthbertson | 150/1 X |

FOREIGN PATENT DOCUMENTS

| | | | |
|---|---|---|---|
| 1007203 | 3/1977 | Canada | 150/12 |
| 1005023 | 2/1978 | Canada | 150/12 |
| 737312 | 6/1980 | U.S.S.R. | 150/3 |

*Primary Examiner*—William Price

*Assistant Examiner*—Sue A. Weaver

*Attorney, Agent, or Firm*—Roylance, Abrams, Berdo & Farley

[57] ABSTRACT

The invention relates to improvements in securing a liner within a flexible container such as an intermediate bulk container. The container has a plurality of first attachment members in the form of connecting ring and mounting straps therefor attached to the exterior of the container adjacent the upper and lower peripheries thereof. The liner has corresponding second attachment members at the top and bottom thereof. Each bottom liner attachment member includes a strap which can pass through a corresponding opening adjacent the bottom of the container and which is provided with an appropriate connector for connection to the corresponding connecting ring on the exterior of the bag. The top liner attachment members is similar to the bottom liner attachment members and, if no cover for the container is required, will pass over the upper edge of the container for connection to an appropriate upper connecting ring. If a cover is provided appropriate openings may be provided to pass the straps of the second attachment members from the interior to the exterior. In this manner a light-weight container may be used; the liner can bear a portion of any loads placed on the container; the liner can be readily removed for repair or replacement; and a container which is otherwise not waterproof can be made waterproof by the addition of a waterproof liner.

12 Claims, 6 Drawing Figures

SECURING A LINER WITHIN A FLEXIBLE CONTAINER

The present invention relates in general to intermediate bulk material containers and in particular to novel mechanisms for removably securing a liner in such a container.

BACKGROUND OF THE INVENTION

An intermediate bulk container is usually considered as being a fairly large bag for storing or transporting bulk material, and in particular for comminuted material. Such containers are often provided with lifting straps or handles so that the container may be lifted and transported by mechanical means such as a fork lift truck. Such bags may be circular or generally square in cross-section and may be formed of various grades of material depending on whether the bag is to be reused or is considered to be disposable.

Intermediate bulk material containers are reasonably well known, examples of such being shown in Canadian Pat. Nos. 1,005,023 and 1,007,203, both issued to Nattrass et al. Such containers utilize a heavy grade woven polyester or nylon base with a P.V.C. or other type of coating. All the seams, spout attachments, lift straps and covers are attached to the container by welding the material together. These containers offer the advantages that: they can be made completely waterproof by sealing the filler and discharge spouts off properly; they can be easily repaired by patching over holes with adhesive or by heat welding; spouts can be replaced in the same manner as can the lift straps thereof; they can be provided with different coatings if the product to be contained therein is sensitive to the P.V.C. coating; and because of their heavy duty construction they can be reused many times. The primary disadvantage to this type of container is the cost thereof.

A second type of intermediate bulk container is known as a "one way" or disposable container and is generally made from woven polypropylene or woven polyethylene. The material of this type of container must be sewn. Such containers are difficult to waterproof as well and hence it has been known to obtain a better degree of moisture protection by inserting a polyethylene liner into the container. If the material is loaded in a heated state into the container then a polybutylene liner may be utilized. These liners are satisfactory in most cases and are used extensively for export where the container is not expected to be returned. Such a "one way" container is relatively inexpensive and is light in weight. However, such a container is almost impossible to repair when damaged as there is no adhesive that will satisfactorily hold a patch in place. To sew on a patch means that it would have to be returned to the manufacturer for repair. Also, the reuse factor is limited as it is difficult to replace the liner after use. Furthermore, for sensitive products complete moisture protection is difficult because of the limitations of polyethylene. Canadian Pat. No. 1,005,023 as mentioned above illustrates a container which utilizes such a liner.

SUMMARY OF THE INVENTION

The present invention combines the benefits of both types of containers discussed above, offering a low cost container that can be used many times with full protection for the product. The present invention utilizes a replaceable liner for the container, thereby permitting the use of a relatively inexpensive outer container and an inner liner which can be removed for repair or replacement as a result of damage or can be replaced so as to obtain better moisture protection. The present invention utilizes a plurality of inter-engageable and releasable attachment means for attaching the inner liner to the outer container.

If a fairly strong liner is used then it may even be unnecessary to provide a top or cover for the container. Otherwise a removable cover which permits access to the interior of the liner should be provided.

In one embodiment the present invention utilizes a plurality of attachment means, such as straps which are secured to the inner liner adjacent the top and bottom thereof. These straps are passed from the interior of the container to the exterior thereof. At the bottom of the container the straps pass through openings in the side wall adjacent the container bottom wall. At the top the straps either pass over the side walls of the container (if no cover) or pass through similar openings between the top or cover and the side walls. On the exterior of the outer container a plurality of mating attachment means are provided so that the attachment means extending from the inner liner to the exterior of the container may be attached to the outer attachment means. In this manner the liner is secured positively within the outer container and cooperating attachment means will distribute the weight of material carried in the liner to the outer container and whatever lifting straps may be provided thereon. The liner can be readily removed from the container for repair or replacement as required.

In summary of the above, therefore, the present invention may be broadly defined as providing for use in an intermediate bulk container including at least side walls having upper and lower peripheries respectively and a bottom wall, the improvement in releasably mounting a liner internally of the container comprising: a plurality of first attachment means secured externally to the side walls of the container adjacent the upper and lower peripheries thereof, and spaced uniformly around the container; a plurality of first openings through the container adjacent the bottom wall, there being one opening associated with each first attachment means adjacent the lower periphery; and a plurality of second attachment means secured to the liner adjacent the top and bottom thereof, there being one second attachment means for said first attachment means; whereby, with the liner located within the container each of the second attachment means can extend from the interior of the container to the exterior thereof and can be releasably secured to a corresponding one of the first attachment means.

DESCRIPTION OF THE PREFERRED EMBODIMENT

Figure 1:
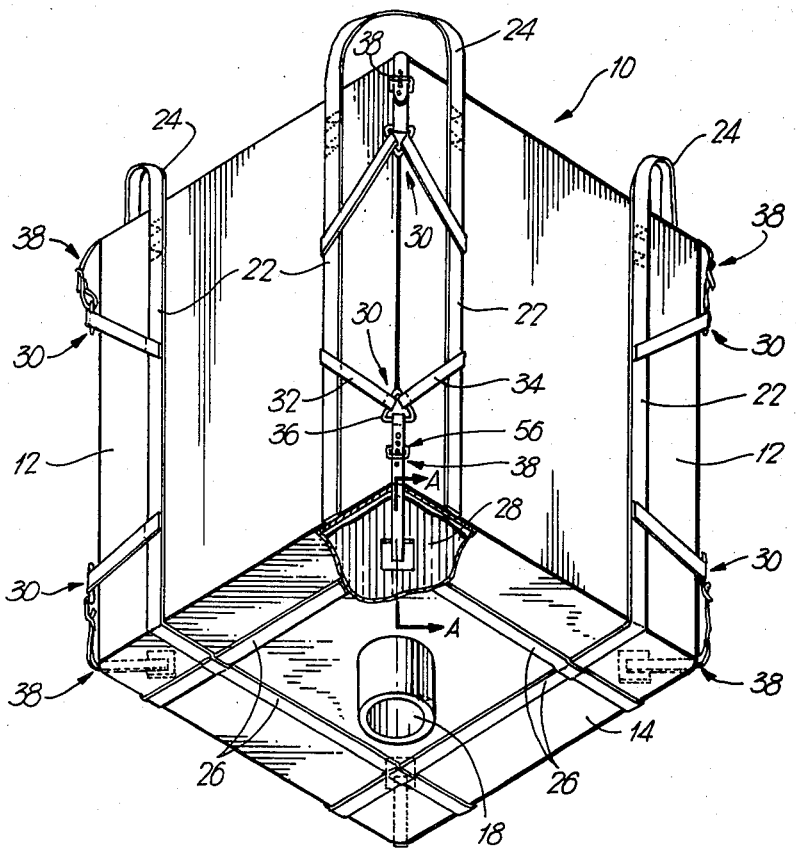
FIG. 1 shows a perspective view of an intermediate bulk container as viewed from the bottom and showing a portion cut away to illustrate a first embodiment of the attachment mechanism of the present invention.
Figure 4:
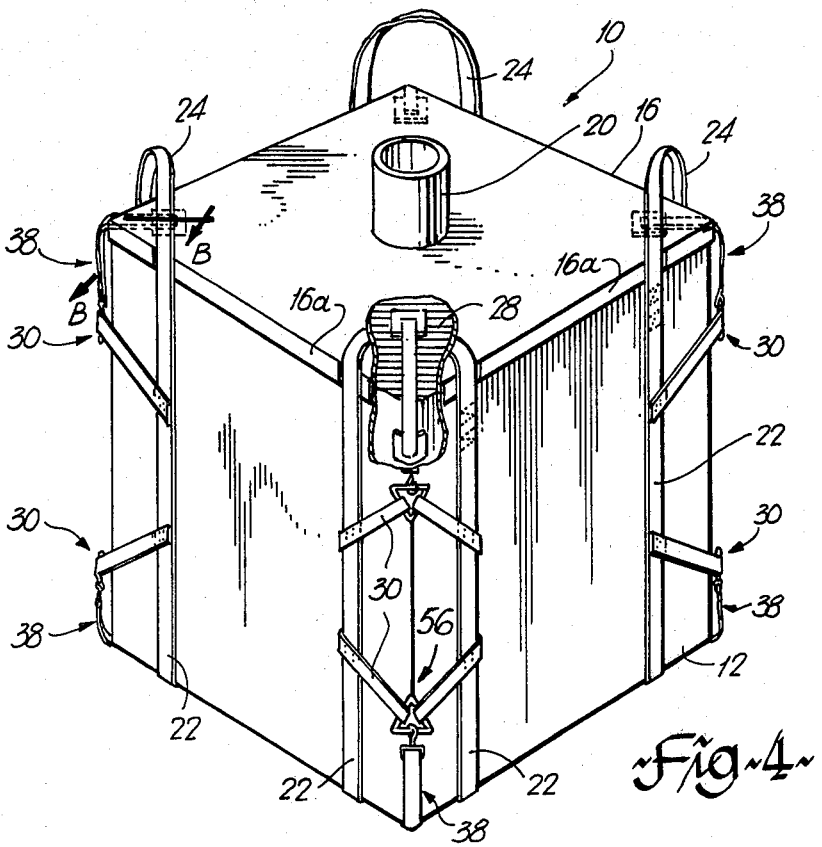
FIG. 4 is a perspective view of an intermediate bulk container as viewed from the top with a portion cut away to illustrate a second embodiment of the attachment means of the present invention.

FIG. 1 illustrates a perspective view of an intermediate bulk container 10 as viewed from the bottom. The container has essentially vertical side walls 12 and a bottom wall 14. The container may also have a top wall or cover 16 which is illustrated in FIG. 4. The cover, if provided, is equipped with means for releasably attaching it to the container. For example side flaps 16*a* may be provided with one half of a hook-and-pile fastener (not shown) with the other half of the fastener being attached to the side walls 12 adjacent the upper periphery thereof. Such a fastener could be that sold under the trademark VELCRO. As seen in FIG. 1, the container is provided with a central dispensing spout 18 in the bottom wall and as seen in FIG. 4 a generally central filler spout 20 may be provided in the top wall 16. If no cover is necessary then the filler spout 20 is usually provided as an integral part of the liner.

A typical intermediate bulk container also has vertically extending reinforcing straps 22 adjacent each corner, pairs of straps 22 terminating adjacent the top of the container in a lifting handle 24. The lifting handles 24 are generally flexible and are adapted for co-operation with the forks of a fork lift truck so that the container may be lifted and transported thereby. The handles 24 may be provided with a mechanism for ensuring that they normally take a generally upright position. Such a mechanism is described and claimed in U.S. Pat. application No. 147,392 filed May 7,1980 and assigned to the assignee of the present invention now U.S. Pat. No. 4,300,608. For additional strength, straps 22 may be extended across the bottom of the container as at 26. Typically the container 10 may be constructed from a heavy grade woven polyester or nylon with a polyvinyl chloride (or other type) of coating. The container may also be a "one way" container made from woven polypropylene or woven polyethylene.

Since the present invention is primarily utilizable with the so called "one way" type of container, it is pointed out that the various seams along the side walls and also between the side walls and the bottom walls are usually sewn. For purposes of achieving a moisture proof container the container is provided with a liner 28 which is flexible in nature and which when filled with material will essentially abut the inner surface of the side and bottom walls. The liner may be formed of polyethylene or polybutylene, for example. Particular advantages are gained, however, if the liner is formed from a light weight polyvinyl chloride coated nylon or polyester with all of the joining seams thereof heat sealed or welded together. Since the liner is intended to be replaceable and since the loads on the container imposed during lifting should not be confined solely to the outer container 10, it is desirable to connect the liner to the container in such a manner as to permit replaceability while also transferring some of the loads to the liner so that the full load carried by the container is not borne by the bottom wall 14.

A unique mechanism for connecting the liner 28 in a releasable manner to the container 10 has been achieved with the present invention. As illustrated in the drawings, the outer container is provided with a plurality of first attachment means 30 secured externally to the side walls 12 of the container, adjacent the upper and lower peripheries thereof respectively. Thus as illustrated in FIGS. 1 and 4 for a generally square container there are two attachment means 30 for each corner, one being adjacent the upper periphery of the container and the other being adjacent the bottom wall or lower periphery. As illustrated in FIGS. 1 and 4, each of the attachment means 30 includes a pair of straps 32, 34, one end of these straps being attached to a triangular ring 36. The ring of course may be circular or of any other suitable cross-section. The straps 32, 34 diverge away from the ring 36 so that the ring is positioned closer to the adjacent periphery of the side wall than the other ends of the straps 32, 34 which are in turn secured to the side walls 12 of the container so that they are spaced apart thereon. The straps 32, 34 may be a woven terylene material or any other suitable material which will be sufficiently strong to bear the loads to be imposed on the container. In the particular embodiment illustrated in FIGS. 1 and 4 the other ends of the straps 32, 34 are also secured to the reinforcing straps 22 which extend vertically of the side walls of the container.

As illustrated in FIGS. 1 and 4 it is also seen that the liner 28 is provided with a plurality of second attachment means 38 secured thereto. There are the same number of second attachment means 38 as first attachment means 30 with each first attachment means 30 corresponding to an appropriate second attachment means 38.

Figure 2:
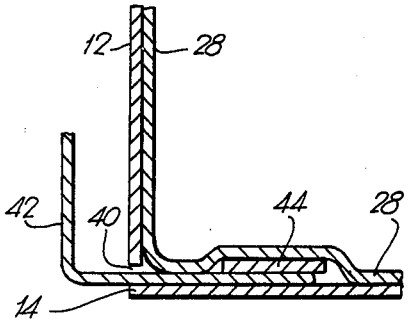
FIG. 2 is a section taken along the lines A—A of FIG. 1.
Figure 5:
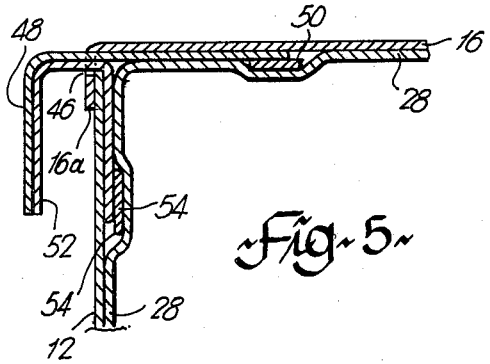
FIG. 5 is a section taken along the lines B—B of FIG. 4.

FIGS. 2 and 5 illustrate two forms of the second attachment means 38. In FIG. 2 the second attachment means associated with the bottom of the liner and the container is illustrated. The liner 28 is illustrated in partial cross-section and the bottom wall 14 is shown in conjunction with the side wall 12. In the vicinity of the corner of the container there is a small opening 40 provided between the side wall 12 and the bottom wall 14. A mounting strap 42 is connected at one end to the liner 28 by way of a mounting pad 44. The strap 42, mounting pad 44 and liner 28 may be heat welded together or, alternatively, any other suitable method of attaching the one end of the strap 42 to the liner 28 may be utilized, such as by sewing, or a combination of sewing and heat welding. As is seen in FIG. 2 of the drawings the strap 42 may extend through the opening 40 so that the strap may thus be led from the interior of the container to the exterior thereof.

FIG. 5 illustrates the second attachment means as provided for the top portion of the liner. In FIG. 5 the side wall 12 is illustrated along with a top wall or cover 16. As with the bottom construction an opening 46 is provided between the top wall 16 and the side wall 12 in the vicinity of the second attachment means. In this instance a first strap 48 is connected at one end to the top surface of the liner 28 by way of a mounting pad 50. A second strap 52 is connected to the side wall of the liner by way of a mounting pad 54. The two straps 48 and 52 extend along the inner surface of the top wall 16 and the side wall 12, respectively, and meet adjacent the opening 46. The two straps are then joined together, in any suitable manner, so that in essence a double strap for the upper portion of the container is provided. The straps 48 and 52 are secured to the liner 28 in the same manner as the bottom straps 42. It is of course understood that a single strap comprising the second attachment means for the liner could be provided at the top, in the same manner as the single strap is provided at the bottom as shown in FIG. 2. Similarly, a double strap arrangement could be provided for the bottom of the liner in the same manner as the double strap arrangement is provided for the top as illustrated in FIG. 5.

In the event that a cover 16 is not deemed necessary the straps 48, 52 would merely extend from the liner inside the container over the top edge of the side walls 12 as an opening 46 as such would not exist.

Figure 3:
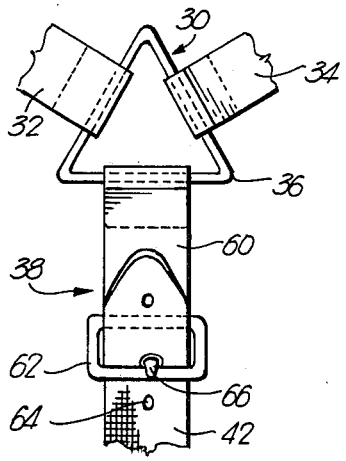
FIG. 3 is an enlarged view of the first embodiment of the connecting means utilized in this invention.
Figure 6:
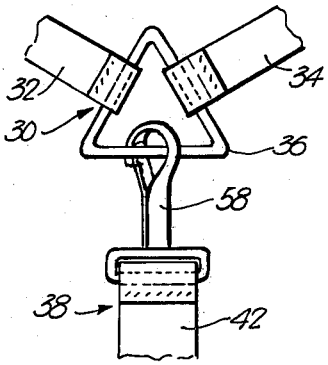
FIG. 6 is an enlarged view of the second embodiment of the connecting means used in this invention.

Several mechanisms could be utilized to connect the first attachment means to the second attachment means. Such connection means are illustrated generally in schematic form in FIGS. 1 and 4 by way of reference numbers 56. FIGS. 3 and 6 illustrate two such connection mechanisms although it is understood that any other alternative attachment mechanism which operates in the desired manner may be utilized.

In FIG. 6 the ring 36 is illustrated along with a portion of the two straps 32 and 34. A single strap 42 such as might be utilized adjacent the bottom of the liner and the container is illustrated terminating adjacent the ring 36. Attached to the strap 42 in any conventional manner is a snap fastener 58 which can easily be snapped onto the ring 36 so as to connect the first attachment means to the second attachment means. The snap fasteners 58 may be easily released so that the liner 28 can be disconnected from the container 10 for easy replacement.

In FIG. 3 the ring 36 is illustrated as having connected thereto a short length of strapping 60 to which is connected the female portion of a belt buckle portion 62. The other end of the strap 42 is provided with a plurality of longitudinally spaced apart holes 64 for cooperation with the prong 66 of the buckle 62. With the embodiment of FIG. 3 the strap 42 of the second attachment means may be buckled to the buckle 62 of the first attachment means to achieve a releasable connection between the liner and the container.

In order to replace a liner 28 which is located within the container 10 and is secured thereto by way of the inter-engageable first and second attachment means, those attachment means are first of all disconnected in an appropriate manner. Thus if the embodiment of FIG. 6 is utilized the snap fasteners 58 are disconnected from the rings 36. If the embodiment of FIG. 3 is utilized then the belt mechanism connecting the straps 42 and 60 are unbuckled from each other. Once all of the second attachment means have been disconnected from the first attachment means it will be seen that the liner is now completely disconnected from the container. Since the cover 16 (if provided) is attached in a manner such that it may be readily removed from the container the cover is then removed and the liner may be then extracted from the container for repair thereof. If the container is one in which a cover is not provided then the liner is merely extracted from the container once the second attachment means have been disconnected from the first attachment means. A new or repaired liner may then be inserted into the container and the various attachment means connected together. If a cover is to be provided then it may be attached to the container 10 so that a completed container, having a lining therein, is provided.

The present invention has been described hereinabove with respect to a preferred embodiment thereof. As indicated, the provision of a cover is optional and, furthermore, various connection means for connecting the first attachment means to the second attachment means may be utilized. Also, the container 10 and liner 28 need not be square or rectangular in transverse cross-section. They could be circular or ovoid in cross-section, the only requirement being that the first and second attachment means be uniformly spaced around the periphery of the container and liner so as to achieve uniform load distribution. Thus the protection to be afforded the present invention should be determined from the claims appended hereto.

The embodiments of the invention in which an exclusive property or privilege is claimed are defined as follows:

1. For use in an intermediate bulk container including at least side walls having upper and lower peripheries respectively and a bottom wall, the improvement in releasably mounting a liner internally of said container comprising:

a plurality of first attachment means secured externally to the side walls of the container adjacent the upper and lower peripheries thereof, and spaced uniformly around said container;

a plurality of first openings through said container adjacent said bottom wall, there being one opening associated with each first attachment means adjacent said lower periphery; and a plurality of second attachment means secured to said liner adjacent the top and bottom thereof, there being one second attachment means for each first attachment means;

whereby, with said liner located within said container each of said second attachment means can extend from the interior of the container to the exterior thereof and can be releasably secured to a corresponding one of said first attachment means.

2. The improvement of claim 1 wherein each of said first attachment means includes a pair of first straps each having one end thereof connected to a connecting ring and the other end thereof secured to the side wall of said container.

3. The improvement of claim 2 wherein said first straps diverge from said ring so that said other ends are spaced apart and so that said ring is closer to the adjacent periphery of the side wall than said other ends.

4. The improvement of claim 2 wherein each second attachment means for the bottom of said liner includes a second strap secured at one end to the bottom of the liner and of a size to pass through a corresponding one of said openings, said second strap having connecting means at the other end for attachment to the ring of an associated first attachment means adjacent the lower periphery of the container.

5. The improvement of claim 4 wherein each second attachment means for the top of the said liner includes a third strap secured at one end to the top of the liner, said third strap having connecting means at the other end for attachment to the ring of an associated first attachment means adjacent the upper periphery of the container.

6. The improvement of claim 5 and including for each second attachment means a fourth strap secured at one end to the side of said liner, said fourth strap being connected to said third strap.

7. The improvement of claim 4, 5 or 6 wherein the connecting means for said second or third straps includes a snap fastener for connection to the ring.

8. The improvement of claim 4, 5 or 6 wherein the connecting means for said second or third straps includes a plurality of spaced apart holes adjacent the other end thereof and said ring on the first strap has attached thereto a buckle for releasably receiving the other end of the second or third straps.

9. The improvement of claim 5 wherein said container is provided with a top wall releasably attached to said side walls so as to define a plurality of second openings leading from the interior of the container to the exterior thereof, there being one second opening associated with each first attachment means adjacent said upper periphery, and wherein said third strap is of a size to pass through a corresponding one of said second openings.

10. The improvement of claim 9 and including for each second attachment means a fourth strap secured at one end to the side of said liner, said fourth strap being connected to said third strap.

11. The improvement of claim 9 or 10 wherein the connecting means for said second or third straps includes a snap fastener for connection to the ring.

12. The improvement of claim 9 or 10 wherein the connecting means for said second or third straps includes a plurality of spaced apart holes adjacent the other end thereof and said ring on the first strap has attached thereto a buckle for releasably receiving the other end of the second or third straps.

* * * * *